US006127322A

United States Patent [19]

Scott et al.

[11] Patent Number: 6,127,322

[45] **Date of Patent: *Oct. 3, 2000**

[54] DISPERSANT ADDITIVES

[75] Inventors: Richard Mark Scott, Sittingbourne; Robert William Shaw, Chester, both of United Kingdom

[73] Assignee: Shell Oil Company, Houston, Tex.

[ * ] Notice: This patent issued on a continued prosecution application filed under 37 CFR 1.53(d), and is subject to the twenty year patent term provisions of 35 U.S.C. 154(a)(2).

[21] Appl. No.: 08/747,470

[22] Filed: Nov. 12, 1996

[30] Foreign Application Priority Data

Nov. 13, 1995 [EP] European Pat. Off. ..... 95308088

[51] Int. Cl.[7] ..... C10M 145/00

[52] U.S. Cl. ..... 508/232; 508/235; 508/241; 508/469; 508/476; 525/285; 525/301

[58] Field of Search ..... 508/232, 235, 508/241, 469, 476; 525/285, 301

[56] References Cited

U.S. PATENT DOCUMENTS

| | | | |
|---|---|---|---|
| 3,455,827 | 7/1969 | Mehmedbasich et al. | 508/235 |
| 4,471,091 | 9/1984 | Hayashi | 525/71 |
| 4,670,173 | 6/1987 | Hayashi et al. | 508/233 |
| 5,186,853 | 2/1993 | Carlisle | 252/51.5 A |
| 5,397,489 | 3/1995 | Carlisle | 508/494 |

FOREIGN PATENT DOCUMENTS

| | | | |
|---|---|---|---|
| 331397 | 9/1989 | European Pat. Off. . | |
| 337602 | 10/1989 | European Pat. Off. . | |
| 352070 | 1/1990 | European Pat. Off. . | |
| 352072 | 1/1990 | European Pat. Off. . | |
| 0 365 288 | 4/1990 | European Pat. Off. . | |
| 365288 | 4/1990 | European Pat. Off. . | |
| 441548 | 8/1991 | European Pat. Off. . | |
| 0450876 | 9/1991 | European Pat. Off. | C10M 159/12 |
| 677572 | 10/1995 | European Pat. Off. . | |
| 682102 | 11/1995 | European Pat. Off. . | |
| 1274647 | 5/1972 | United Kingdom . | |
| 2097800 | 2/1997 | United Kingdom . | |

*Primary Examiner*—Jacqueline V. Howard
*Assistant Examiner*—Cephia D. Toomer

[57] ABSTRACT

The reaction product of (i) an oligomer formed from one monomer or two or more different monomers, the or each monomer being an ethylenically unsaturated compound and said oligomer or each of said monomers being optionally partially or fully esterified, with (ii) a polyalkenyl derivative of an ethylenically unsaturated carboxylic reagent (iii), and (iv) a polyamine containing at least two —$NH_2$ and/or —NH groups, wherein at least one of the ethylenically unsaturated compounds of the oligomer has a functional group which can react with an amine; and the use of the reaction product for its dispercency and low haze properties in lubricant compositions, fuel compositions and additive concentrates.

16 Claims, No Drawings

DISPERSANT ADDITIVES

FIELD OF THE INVENTION

The present invention relates to reaction products of polyalkenes, a process for their preparation, lubricating oil compositions, fuel compositions and additive concentrates containing them and their use as dispersant additives.

SUMMARY OF THE INVENTION

It has surprisingly been found that certain nitrogen-containing reaction products of polyalkenes have low haze and good dispersancy properties and exhibit good compatibility towards seals and bearings.

In accordance with the present invention, there is provided the reaction product of:

(i) an oligomer formed from one monomer or two or more different monomers, each monomer being an ethylenically unsaturated compound and said oligomer or each of said monomers being optionally partially or fully esterified, with (ii) a polyalkenyl derivative of an ethylenically unsaturated carboxylic reagent (iii), and (iv) a polyamine containing at least two —$NH_2$ and/or —NH groups, wherein at least one of the ethylenically unsaturated compounds of the oligomer has a functional group which can react with an amine, the oligomeric reaction product optionally being further reacted with a low molecular weight amine. In the alternative, the reaction product is obtained by esterfying the oligomer (i) with a pre-formed product (v) that is obtained by contacting reagents (ii) and (iv). The resulting reaction products are useful as disperssant additives.

DESCRIPTION OF PREFERRED EMBODIMENTS

The low molecular weight amines have molecular weights in the range 17 to 300. For example and not as a limitation, suitable amines include oleylamine or benzylamine. Aniline or a polyamine containing at least two —$NH_2$ or —NH groups are preferred, with aniline being the most preferred.

The ethylenically unsaturated carboxylic reagent (iii) contains a total of at least 3 carbon atoms, preferably a total of from 3 to 50, more preferably from 3 to 30, still more preferably from 4 to 20, and even more preferably from 4 to 10, carbon atoms.

The ethylenically unsaturated carboxylic reagent may be an alpha-beta olefinic unsaturated carboxylic reagent as described in page 6, lines 15 to 48 of EP-B-0285609 or page 6, lines 11 to 39 of EP-B-0287569 (both are incorporated herein by reference). Examples of the carboxylic reagent (iii) include acrylic acid ($C_3$), methacrylic acid ($C_4$), cinnamic acid ($C_9$), crotonic acid ($C_4$), 2-phenylpropenoic acid ($C_9$), maleic acid ($C_4$), fumaric acid ($C_4$), glutaconic acid ($C_5$), mesaconic acid ($C_5$), itaconic acid (methylene succinic acid) ($C_5$), citraconic acid (methyl maleic acid) ($C_5$) and functional derivatives thereof such as anhydrides (e.g. maleic anhydride ($C_4$), glutaconic anhydride ($C_5$), itaconic anhydride ($C_5$), citraconic anhydride ($C_5$)), esters (e.g. methyl acrylate ($C_4$)), amides, imides, salts, acyl halides and nitriles.

Preferably the ethylenically unsaturated carboxylic reagent (iii) is selected from monoethylenically unsaturated $C_4$–$C_{10}$ dicarboxylic acids and anhydrides, of which maleic anhydride is most preferred.

The polyalkenyl derivative (ii) of an ethylenically unsaturated carboxylic reagent (iii) may be prepared by methods known in the art. For example, if the ethylenically unsaturated carboxylic reagent (iii) is maleic anhydride, the polyalkenyl derivative thereof may conveniently be prepared by mixing a polyalkene with a specified amount of maleic anhydride and passing chlorine through the mixture, e.g. as described in GB-A-949981 (which is incorporated herein by reference). Alternatively, the derivative may be prepared by reacting thermally, at an appropriate temperature, the polyalkene with a specified amount of maleic anhydride, e.g. as described in GB-A-1483729 (incorporated herein by reference). A preferred process for preparing such a derivative, which is described in EP-A-0542380 (incorporated herein by reference), involves reacting the polyalkene with maleic anhydride in a mole ratio of maleic anhydride to polyalkene of greater than 1:1, at a temperature in the range from 150 to 260° C. and in the presence of a polyaddition-inhibiting amount of a sulphonic acid.

The polyalkene used to prepare the polyalkene derivative may be a homopolymer or copolymer ro combinations thereof. For example, suitable polyalkenes are those having at least one $C_{2-10}$ monoolefin. Preferably the polyalkene is a polymer of at least one $C_{2-5}$ monoolefin such as an ethylene-propylene copolymer. The monoolefin is more preferably a $C_{3-4}$ olefin, such as propylene or isobutylene, and preferred polyalkenes derived therefrom include polyisobutylenes and atactic or isotactic or syndiotactic propylene oligomers. Polyisobutylenes such as that sold by BASF under the trade mark "GLISSOPAL" and those sold by the British Petroleum Company under the trade marks "ULTRAVIS, "HYVIS" and "NAPVIS", e.g. "HYVIS 75", "HYVIS 120", "HYVIS 200" and "NAPVIS 120" polyisobutylenes, are especially preferred for use in the present invention.

The polyalkene has a number average molecular weight ($M_n$) preferably in the range from 300 to 7000, more preferably from 500 to 5000, still more preferably from 700 to 3000.

The polyamine (iv) contains at least two —$NH_2$ and/or —NH groups, the groups each having at least one active hydrogen thereon. Without limitation, examples of polyamines useful in the present invention are those described in the text from page 16, line 21 to page 19, line 53 of EP-B-0287569 (incorporated herein by reference).

In one embodiment of the invention, a preferred polyamine is a compound of the general formula:

$$H_2N—(CHR^1)_x—CH_2—[A—CH_2—(CHR^1)_x]_y—NH_2 \quad (I)$$

wherein A is —NH or —O—, each $R^1$ independently represents a hydrogen atom or a methyl group, x is in the range 1 to 3, and y is in the range 1 to 10 when A is —NH, or y is in the range 1 to 200 when A is —O—.

In formula (I) above, it is preferred that when A is —NH, then x is 1, each $R^1$ represents a hydrogen atom, and y is in the range 1 to 8; or when A is —O—, then x is 1, each $R^1$ represents a methyl group and y is in the range 1 to 50.

Reagent (v) is the pre-formed product of reagents (ii) and (iv) and may be prepared according to techniques conventional in the art. Thus, for example, if the reagent (ii) is a polyalkenyl derivative of maleic anhydride and the polyamine is ethylene polyamine, they may conveniently be reacted together in a molar ratio of polyalkenyl derivative to polyamine from 1–4:1, in the presence of a hydrocarbon solvent at a temperature in the range from 100 to 250° C., e.g. as described in EP-A-0587250.

The ethylenically unsaturated compounds may be selected from any compounds that can be oligomerised, such as alpha-olefins and alpha-beta-unsaturated carbonyl compounds. Particularly suitable compounds include, without limitation, styrene, maleic anhydride and acrylic acid.

The reaction between said ethylenically unsaturated monomers to form the oligomer may be carried out by radical cationic or anionic oligomerisation. Said oligomers are selected from those having a functional group that will react with an amine, more preferably styrene copolymerised with maleic anhydride, styrene copolymerised with acrylic acid, polyacrylic acid, and alpha-olefins copolymerised with maleic anhydride.

Reaction products of the present invention, whether produced from oligomers (i) in which either the oligomer or one or more of the monomers thereof has been partially or fully esterified, or from oligomers (i) in respect of which there has been no such esterification, exhibit good dispersancy properties. However, it has been found that those produced from oligomers (i) where there has been partial or full esterification exhibit low haze levels, thus reducing the need for further treatment such as filtration. Such esterification of these oligomers or their monomers may be carried out by reaction with an alcohol, e.g. $C_{1-20}$ aliphatic or aromatic alcohols, preferably in the presence of a catalyst such as para-toluenesulphonic acid (PTSA).

However, there are commercially available (1) co-oligomers of such ethylenically unsaturated compounds, and (2) partially-esterified forms of co-oligomers (1). Examples of (1) are styrene/maleic anhydride co-oligomers (SMA), such as those sold by Elf-Atochem under the trade names 'SMA 1000A', 'SMA 2000' and 'SMA 3000A'. An example of (2) is a half-ester of said 'SMA 3000A' with iso-octyl alcohol, sold by Elf-Atochem under the trade name 'SMA 3840A'. It has been found that by use of partially- or fully-esterified forms of such commercially available SMAs, such as commercially available partially-esterified forms of the SMAs, or by use of esterified polyacrylic acid, for example, poly n-amyl acrylate, dispersants can be produced having low haze levels (as measured according to ASTM D1003).

The esterification of the SMAs to produce fully esterified oligomers, i.e. diesters, is preferably carried out using $C_{1-20}$ aliphatic or aromatic alcohols, more preferably $C_{5-8}$ branched aliphatic alcohols, in particular iso-amyl alcohol (which is a mixture of branched alcohols, mainly 3-methylbutan-1-ol and 2-methylbutan-1-ol) or iso-octyl alcohol, more particularly in excess. The esterification of polyacrylic acid is preferably carried out using $C_{1-20}$ aliphatic or aromatic alcohols, for example straight chain aliphatic alcohols, in particular n-amyl alcohol. Said esterification processes are preferably carried out at a temperature in the range 0 to 250° C., more preferably 70 to 190° C., at a pressure in the range 0.5 to 10 atmospheres (50 to 1000 kPa), more preferably atmospheric pressure, in the presence of a solvent in the presence of a catalyst. The solvent may be selected from alcohols, aromatic hydrocarbons (such as toluene, wylene and mesitylene) and ethers (such as tetrahydrofuran and 1,4-dioxane), and mixtures thereof. Preferred catalyust are acids (such as sulphuric acid and PTSA), Lewis acids (such as aluminium chloride), and bases (such as pyridine and 4-(N,N-dimethylamino)-pyridine). Where the solvent is reactive, e.g. an alcohol such as iso-octyl alcohol, reaction with the oligomer (i) may occur concomitantly with reaction with the polyamine (iv) or with (v).

In another embodiment of the present invention, a process for the preparation of an oligomeric reaction product as defined above is provided. The process comprises reacting:

(i) an oligomer formed from one monomer or two or more different monomers, monomer being an ethylenically unsaturated compound and said oligomer or each of said monomers being optionally partially or fully esterified, with (ii) a polyalkenyl derivative of an ethylenically unsaturated carboxylic reagent (iii), and (iv) a polyamine containing at least two —$NH_2$ and/or —NH groups, wherein at least one of the ethylenically unsaturated compounds of the oligomer has a functional group which can react with an amine, the oligomeric reaction product optionally being further reacted with a low molecular weight amine. In another embodiment of the process, the process comprises reacting the oligomer (i) with a pre-formed product obtained by reacting reagents (ii) and (iv).

The reaction between (i), (ii) and (iv) or in the alternative between (i) and (v), is preferably carried out in the presence of a suitable solvent at elevated temperature (i.e. above ambient temperature 20° C. such as temperatures in the range of 25 to 200° C., wherin temperatures in the range of 160 to 200° C. is preferred), often under reflux conditions and, where necessary, at elevated pressure (such as pressures in the range from 2 to $100\times10^5$ Pa.) Without limitation, examples of solvents include hydrocarbon solvents such as hexane, cyclohexane, toluene, xylene, mesitylene; also synthetic and mineral oils such as HVI-60; ether solvents such as tetrahydrofuran and 1,4-dioxane; nitriles such as acetonitrile; alcohols such as 1-pentanol (amyl alcohol) and 2-methyl-2-propanol (tert-butyl alcohol); and chlorohydrocarbons such as 1,1,1-trichloroethane. Alternatively, the process may be carried out in the absence of a solvent but, as indicated above, is conveniently carried out in the presence of one or more solvents. Any water or excess of alcohol may be removed means which are generally known in the industry such as a Dean and Stark trap.

The weight ratio (ii):(iv) in the process of the present invention is preferably in the range from 100:1 to 5:1, more preferably from 33:1 to 13:1, and the weight ratio (iv):(i) is preferably in the range from 1:20 to 20:1, more preferably from 1:5 to 5:1.

In another embodiment of the present invention, the reaction product as a dispersant additive in lubricating oils. Accordingly, the present invention provides a lubricating oil composition comprising (a) a major amount (more than 50% w) of a lubricating oil and (b) a minor amount (less than 50% w), preferably from 0.1 to 20% w, with from 0.5 to 10% w being more preferred (active matter) of a reaction product according to the present invention, the percentages by weight being based on the total weight of the composition.

Suitable lubricating oils are natural, mineral or synthetic lubricating oils.

Natural lubricating oils include animal and vegetable oils, such as castor oil. Mineral oils comprise the lubricating oil fractions derived from crude oils, coal or shale, which fractions may have been subjected to certain treatments such as clay-acid, solvent or hydrogenation treatments. Synthetic lubricating oils include synthetic polymers of hydrocarbons, modified alkylene oxide polymers, and ester lubricants, which are known in the art. These lubricating oils are preferably crankcase lubricating oils for spark-ignition and compression-ignition engines, but include also hydraulic lubricants, metal-working fluids and automatic transmission fluids.

Preferably the lubricating base oil component of the compositions according to the present invention is a mineral lubricating oil or a mixture of mineral lubricating oils, such as those sold by member companies of the Royal Dutch/Shell Group under the designations "HVI", or the synthetic hydrocarbon base oils sold by member companies of the Royal Dutch/Shell Group of Companies under the designation "XHVI" (trade mark).

The viscosity of the lubricating base oils present in the compositions according to the present invention may vary within wide ranges, and is generally from 3 to 35 $mm^2/s$ at 100° C.

The lubricating oil compositions according to the present invention may contain various other additives, known in the art, such as viscosity index improvers, e.g. linear or star-shaped polymers of a diene such as isoprene or butadiene, or a copolymer of such a diene with optionally substituted styrene. These copolymers are suitably block copolymers and are preferably hydrogenated to such an extent as to saturate most of the olefinic unsaturation. Other suitable additives include dispersant V.I. improvers such as those based on block copolymers, or polymethacrylates, extreme pressure/anti-wear additives such as zinc or sodium dithiophosphates, ashless dispersants such as polyolefin-substituted succinimides, e.g. those described in GB-A-2231873 (incorporated herein by reference), anti-oxidants, anti-rust additives, friction modifiers or metal-containing detergents such as phenates, sulphonates, alkylsalicylates or naphthenates, all of which detergents may be overbased.

In another embodiment of the present invention, the reaction product is used as a dispersant additive in fuels. Accordingly, the fuel composition comprises: (a) a major amount (more than 50% w) of a fuel and (b) a minor amount (less than 50% w), such as from 0.001 to 2% w, with from 0.001 to 0.5% w being preferred and amounts from 0.002 to 0.2% w being more preferred (active matter), of a reaction product according to the invention, the percentages by weight being based on the total weight of the composition.

Suitable fuels include gasoline and diesel fuel. These base fuels may comprise mixtures of saturated, olefinic and aromatic hydrocarbons. They can be derived from straight-run gasoline, synthetically produced aromatic hydrocarbon mixtures, thermally catalytically cracked hydrocarbon feedstocks, hydrocracked petroleum fractions or catalytically reformed hydrocarbons.

The fuel compositions according to the present invention may contain various other additives known in the art such as a lead compound as anti-knock additive; antiknock additives other than lead compounds such as methyl cyclopentadienyl-manganese tricarbonyl or ortho-azidophenyl; co-antiknock additives such as benzoylacetone; dehazers (e.g. ethoxylated glycerols such as that commercially available as "SURDYNE" (trade mark) M155 (obtianable from Shell Chemicals, UK) or alkoxylated phenol formaldehyde polymers such as those commercially available as "NALCO" (trade mark) 7DO7 (ex Nalco), "TOLAD" (trade mark) 2683 (obtainable from Petrolite) or "SURDYNE" (trade mark) D265, M153, M154 or M156 (obtainable from Shell Chemicals, UK)); anti-foaming agents (e.g. the polyether-modified polysiloxanes commercially available as "TEGOPREN" (trade mark) 5851, Q 25907 (obtainable from Dow Corning) or "RHODORSIL" (trade mark) (obtained from Rhone Poulenc)); ignition improvers (e.g. 2-ethylhexyl nitrate, cyclohexyl nitrate, di-tertiary-butyl peroxide and those disclosed in U.S. Pat. No. 4,208,190 at Column 2, line 27 to Column 3, line 21; incorporated herein by reference); anti-rust agents (e.g. that commercially sold by Rhein Chemie, Mannheim, Germany as "RC 4801", or polyhydric alcohol esters of a succinic acid derivative, the succinic acid derivative having on at least one of its alpha carbon atoms an unsubstituted or substituted aliphatic hydrocarbon group containing from 20 to 500 carbon atoms (e.g. the pentaerythritol diester of polyisobutylene-substituted succinic acid); reodorants; anti-wear additives; anti-oxidants (e.g. phenolics such as 2,6-di-tert-butylphenol, or phenylenediamines such as N,N'-di-sec-butyl-p-phenylenediamine); metal deactivators; lubricity agents (e.g. those commercially available as EC831 (obtainable from Paramins) or "HITEC" (trade mark) 580 (obtainable from Ethyl Corporation)); or carrier fluids such as a polyether e.g. a $C_{12}$–$C_{15}$ alkyl-substituted propylene glycol ("SAP 949" which is commercially available from member companies of the Royal Dutch/Shell group), "HVI" or "XHVI" (trade mark) base oil, a polyolefin derived from $C_2$–$C_6$ monomers, e.g. polyisobutylene having from 20 to 175, particularly 35 to 150, carbon atoms, or a polyalpha-olefin having a viscosity at 100° C. in the range $2\times10^{-6}$ to $2\times10^{-5}$ $m^2/s$ (2 to 20 centistokes), being a hydrogenated oligomer containing 18 to 80 carbon atoms derived from at least one alphaolefinic monomer containing from 8 to 18 carbon atoms.

The lubricating oil and fuel compositions of the invention may be prepared by adding the reaction product of the present invention to a lubricating oil or fuel. Conveniently, an additive concentrate is blended with the lubricating oil or fuel. Such a concentrate generally comprises an inert carrier fluid and one or more additives in a concentrated form. Hence the present invention also provides an additive concentrate comprising an inert carrier fluid and from 10 to 80% w (active matter) of a reaction product according to the present invention, the percentages by weight being based on the total weight of the concentrate.

Examples of inert carrier fluids include hydrocarbons and mixtures of hydrocarbons with alcohols or ethers, such as methanol, ethanol, propanol, 2-butoxyethanol or methyl tert-butyl ether. For example, the carrier fuid may be an aromatic hydrocarbon solvent such as toluene, xylene, mixtures thereof or mixtures of toluene or xylene with an alcohol. Alternatively, the carrier fluid may be a mineral base oil or mixture of mineral base oils, such as those sold by member companies of the Royal Dutch/Shell Group under the designations "HVI", e.g. "HVI 60" base oil, or the synthetic hydrocarbon base oils sold by member companies of the Royal Dutch/Shell Group of Companies under the designation "XHVI" (trade mark).

The present invention still further provides the use of a reaction product according to the present invention as a dispersant additive.

The present invention will be further understood from the following illustrative examples that are included for illustrative purposes only and are not to be construed as limiting the invention. In these Examples, the number average molecular weights ($M_n$) specified for the polyisobutenyl moieties in the polyisobutenyl succinic anhydride/succinimide were determined by modern gel chromatography using polystyrene standards, e.g. as described in W. W. Yau, J. J. Kirkland and D. D. Bly, "Modern Size Exclusion Liquid Chromatography", John Wiley and Sons, New York, 1979.

Active matter content was determined by separating inactive material from the desired active matter on an aluminium oxide column using diethyl ether as eluant; acid value was determined according to ASTM D 664; and Total Base Number was determined in accordance with ASTM D 2896.

In the Examples, the following abbreviations are used:

PIBSA: a polyisobutenyl succinic anhydride in which the polyisobutenyl moiety has $M_n$ (as measured by GPC) of 2200±200 in Examples 1 to 12 and 28 to 35, and 950±100 in Examples 13 to 27, prepared by the process according to EP-A-0542380

TEPA: tetraethylene pentamine

S75: a polyamine mixture containing tetraethylene pentamine, pentaethylene hexamine and higher ethylene polyamines in a weight ratio of 1:2:1 which is commercially available from Delamine B.V., Netherlands

EXAMPLE 1

A mono-ester of SMA 3000A and iso-octyl alcohol ('SMA 3840A' ex. Elf-Atochem) (1.5 g) dissolved in 'Shellsol A' (99% aromatics, B.Pt. 166–180° C.) (150 ml) was added to a stirred solution of the reaction product of PIBSA and S75 (having a coupling ratio (mols of PIBSA to mols of polyamine) of 1.4 to 1.7) (50 g, 40.9% active matter ) in 'Shellsol A' (50 ml) at 150° C. The reaction temperature was increased at approx. 15° C. per hour and the 'Shellsol A', water and any alcohol released was removed by a Dean and Stark trap. Heating rates can be varied. Once the temperature had reached 200° C., the reaction was held at this temperature for 1 hour. The excess solvent was removed under reduced pressure.

EXAMPLES 2 to 35

By processes similar to that described in Example 1 above, further reaction products of the present invention were prepared, namely those of Examples 2 to 10 and 12 to 35. The reaction product of Example 11 was prepared by reacting the PIBSA, polyamine and mono-ester 'SMA 3840A' together, without preparing a preformed product of the PIBSA and the polyamine.

Details of the types and amounts of the reagents used and, where known, the total base number and nitrogen content of the polyimide derivatives as obtained are presented in Table 1 below, in which the percentage of reactant B is of the total weight of reactant A without adjustment to take account of the percentage of active matter in A:

TABLE 1

| | Reactants | | | Product | | |
|---|---|---|---|---|---|---|
| | | | | | Total | |
| Example No. | | % Active matter of A | % B | % Active matter | Base Number (mg KOH/g) | Nitrogen content (% w) |
| 1 | A = PIBSA + S75<br>B = mono-ester of SMA 3000A and iso-octyl alcohol | 40.9 | 3.0 | 42.8 | 21.6 | 0.95 |
| 2 | A = PIBSA + S75<br>B = diester of SMA 3000A and iso-amyl alcohol | 40.9 | 2.5 | 41 | 22.6 | 0.93 |
| 3 | A = PIBSA + S75<br>B = diester of SMA 3000A and iso-amyl alcohol | 40.9 | 4.7 | 42 | 22.0 | 0.95 |
| 4 | A = PIBSA + S75<br>B = diester of SMA 3000A and iso-amyl alcohol | 40.9 | 10.0 | 43 | 20.6 | 0.89 |
| 5 | A = PIBSA + S75<br>B = diester of SMA 3000A and iso-amyl alcohol | 40.9 | 5.0 | 42 | 22.8 | 0.91 |
| 6 | A = PIBSA + S75<br>B = mono-ester of SMA 3000A and iso-octyl alcohol | 40.9 | 1.0 | 43.1 | 23.2 | 0.95 |

TABLE 1-continued

| | Reactants | | | Product | | |
|---|---|---|---|---|---|---|
| | | | | | Total | |
| Example No. | | % Active matter of A | % B | % Active matter | Base Number (mg KOH/g) | Nitrogen content (% w) |
| 7 | A = PIBSA + S75<br>B = mono-ester of SMA 3000A and iso-octyl alcohol | 40.9 | 2.0 | 44.6 | 21.2 | 0.92 |
| 8 | A = PIBSA + S75<br>B = mono-ester of SMA 3000A and iso-octyl alcohol | 40.9 | 4.0 | 43.2 | 20.8 | 0.97 |
| 9 | A = PIBSA + S75<br>B = mono-ester of SMA 3000A and iso-octyl alcohol | 40.9 | 5.0 | 44.9 | 18.9 | 0.93 |
| 10 | A = PIBSA + S75<br>B = mono-ester of SMA 3000A and iso-octyl alcohol | 40.9 | 6.0 | 46.5 | 18.2 | 0.90 |
| 11 | A1 = PIBSA<br>A2 = S75<br>B = mono-ester of SMA 3000A and iso-octyl alcohol | 60 | 6.0 | 60.2 | NM | NM |
| 12 | A = PIBSA + S75<br>B = mono-ester of SMA 3000A and iso-octyl alcohol | 40.9 | 7.0 | 45.1 | 18.0 | 0.92 |
| 13 | A = PIBSA + TEPA<br>B = mono-ester of SMA 3000A and iso-octyl alcohol | 46.8 | 2.5 | 47.8 | 44.7 | 1.93 |
| 14 | A = PIBSA + TEPA<br>B = mono-ester of SMA 3000A and iso-octyl alcohol | 60.0 | 3.0 | 61 | 55.5 | 2.43 |
| 15 | A = PIBSA + TEPA<br>B = mono-ester of SMA 3000A and iso-octyl alcohol | 46.8 | 3.0 | 48.2 | 44.0 | 1.91 |
| 16 | A = PIBSA + TEPA<br>B = mono-ester of SMA 3000A and iso-octyl alcohol | 60.0 | 4.0 | 61 | 56.7 | 2.43 |
| 17 | A = PIBSA + TEPA<br>B = mono-ester of SMA 3000A and iso-octyl alcohol | 46.8 | 4.0 | 48.6 | NM | 1.92 |
| 18 | A = PIBSA + TEPA<br>B = mono-ester of SMA 3000A and iso-octyl alcohol | 46.8 | 5.0 | 48.8 | 43.4 | 1.87 |
| 19 | A = PIBSA + TEPA<br>B = mono-ester of SMA 3000A and iso-octyl alcohol | 46.8 | 6.0 | 49.3 | 40.9 | NM |
| 20 | A = PIBSA + TEPA<br>B = mono-ester of SMA 3000A and iso-octyl alcohol | 46.8 | 7.0 | 49.2 | 41.0 | 1.89 |
| 21 | A = PIBSA + TEPA<br>B = mono-ester of SMA 3000A and iso-octyl alcohol | 46.8 | 8.0 | 50.3 | NM | NM |
| 22 | A = PIBSA + TEPA<br>B = mono-ester of SMA 3000A and iso-octyl alcohol | 46.8 | 10.0 | 50.8 | NM | NM |
| 23 | A = PIBSA + TEPA<br>B = mono-ester of SMA 3000A and iso-octyl alcohol | 46.8 | 15.0 | 47.4 | 34.4 | 1.76 |

TABLE 1-continued

| Example No. | Reactants | % Active matter of A | % B | Product % Active matter | Product Total Base Number (mg KOH/g) | Product Total Nitrogen content (% w) |
|---|---|---|---|---|---|---|
| 24 | A = PIBSA + TEPA B = mono-ester of SMA 1000A and iso-octyl alcohol | 46.8 | 5.0 | 49.5 | NM | NM |
| 25 | A = PIBSA + TEPA B = mono-ester of SMA 1000A and iso-octyl alcohol | 46.8 | 10.0 | 49.6 | NM | NM |
| 26 | A = PIBSA + TEPA B = mono-ester of SMA 1000A and iso-octyl alcohol | 46.8 | 15.0 | 43.2 | NM | NM |
| 27 | A = PIBSA + TEPA B = mono-ester of SMA 1000A and iso-octyl alcohol | 46.8 | 20.0 | 47.3 | NM | NM |
| 28 | A = PIBSA + S75 B = mono-ester of SMA 3000A and iso-octyl alcohol | 60 | 4.0 | 60.1 | 54.2 | 2.02 |
| 29 | A = PIBSA + TEPA B = mono-ester of SMA 3000A and iso-octyl alcohol | 42.2 | 4.0 | 43.8 | 26.3 | 1.12 |
| 30 | A = PIBSA + TEPA B = mono-ester of SMA 3000A and iso-octyl alcohol | 42.6 | 4.0 | 43.7 | 29.3 | 1.14 |
| 31 | A = PIBSA + S75 B = mono-ester of SMA 3000A and iso-octyl alcohol | 42 | 4.0 | 44.5 | 35.8 | 1.37 |
| 32 | A = PIBSA + S75 B = poly n-amyl acrylate | 40.9 | 3.0 | NM | 20.1 | 0.95 |
| 33 | A = PIBSA + S75 B = poly n-amyl acrylate | 40.9 | 5.0 | 43.6 | 16.7 | 0.94 |
| 34 | A = PIBSA + S75 B = poly n-amyl acrylate (post-treated with aniline) | 40.9 | 3.0 | NM | 24.9 | 1.1 |

Notes to Table 1:
(a) 'SMA 3000A' is a styrene/maleic anhydride oligomer in which the mole ratio of styrene:maleic anhydride is 3:1 (ex. Elf-Atochem)
(b) 'SMA 1000A' is a styrene/maleic anhydride oligomer in which the mole ratio of styrene:maleic anhydride is 1:1 (ex. Elf-Atochem)
(c) Reactant B in Examples 1, 6 to 23 and 28 to 32 was 'SMA 3840A', a low molecular weight (approx. 2800) oligomer in which the mole ratio of styrene:maleic anhydride is 3:1, and in which the maleic anhydride has been reacted with iso-octyl alcohol to form the mono-ester (ex. Elf-Atochem)
(d) Reactant B in Examples 33 to 35 was a low molecular weight (approx. 2000) polyacrylic acid esterified with n-amyl alcohol
(e) Reactant A in Examples 1 to 10, 12 and 33 to 35 had a coupling ratio (mols of PIBSA to mols of polyamine) of 1.66:1
(f) Reactant A in Examples 28 to 32 had a coupling ratio (mols of PIBSA to mols of polyamine) of 1.36:1
(g) Reactant A in Examples 13 to 27 was 'SAP 230TP', a mono/bis succinimide ashless dispersant having a coupling ratio (mols of PIBSA to mols of polyamine) of 1.66:1 (ex. Shell International Chemical Co. Ltd.)
(h) 'NM' = Not Measured

EXAMPLE 35

Haze Test

"Haze" is that percentage of transmitted light which, in through the specimen, deviates from the incident beam by forward scattering. For the purpose of this method only light flux deviating more than 2.5° on average is considered to be haze.

The dispersant is dissolved in HVI 60 oil, at 100° C., in a mass ratio of 1:9. The haze of the solution is measured by means of a pivotable-sphere hazemeter, applying a correction for the haze of the solvent. The hazemeter is as specified in ASTM D1003 with digital display reading to 0.1%.

TABLE 2

| Example No. | Haze (%) | Example No. | Haze (%) |
|---|---|---|---|
| 1 | 5.0 | 12 | 14.7 |
| 2 | 9.6 | 13 | 0.1 |
| 3 | 8.8 | 18 | 1.3 |
| 4 | 6.2 | 22 | 1.0 |
| 5 | 7.1 | 23 | 0.4 |
| 6 | 7.9 | 24 | 2.8 |
| 7 | 5.2 | 25 | 2.0 |
| 8 | 5.0 | 26 | 1.8 |
| 9 | 10.3 | 27 | 4.3 |
| 10 | 7.1 | 33 | 4.3 |

It can be seen from the figures in Table 2 that reaction products of the present invention exhibit low levels of haze.

EXAMPLE 36

Carbon Black Dispersancy Test (CBDT)
(British Rail Publication BR 669: 1984)

Samples of a SAE 15W40 Middle East lubricating oil containing a commercial package of a zinc dialkyldithiophosphate, an overbased calcium alkyl salicylate and VI improver, were modified by incorporation of the oligomeric reaction products of Examples 1 to 34 to give oils containing the derivatives at a concentration of 1% w active matter. 3% w of carbon black was then added to each oil and (percentage) increase in kinematic viscosity at 60° C. was determined, using an Ubbelohde viscometer. A low result indicates good performance. The absolute values obtained are dependent on the active surface area of the carbon black used, and therefore comparative series should be tested was identical samples of carbon black. The tests were carried out using "Flamruss" (trade mark) carbon black.

The results of these tests are given in Table 3:

TABLE 3

| Example No. | CBDT (%) | Example No. | CBDT (%) |
|---|---|---|---|
| 1 | 15.3 | 17 | 16.2 |
| 2 | 14 | 18 | 14.7 |
| 3 | 18 | 19 | 18.4 |
| 4 | 23 | 20 | 15.2 |
| 5 | 13.7 | 21 | 15.3 |
| 6 | 15.9 | 22 | 14.8 |
| 7 | 15.9 | 23 | 15.3 |
| 8 | 15.5 | 28 | 14.8 |
| 9 | 18.3 | 29 | 16.6 |
| 10 | 19.5 | 30 | 15.3 |
| 11 | 20.3 | 31 | 14.8 |
| 12 | 17.2 | 32 | 17.6 |
| 13 | 15.7 | 33 | 18.1 |
| 15 | 15.3 | 34 | 16.7 |

What is claimed is:

1. A reaction product of: (i) an oligomer formed from one monomer or two or more different monomers, the or each monomer being an ethylenically unsaturated compound, said oligomer or each of said monomers being optionally partially or fully esterified, wherein the oligomer formed is selected from the group consisting of styrene copolymerized with maleic anhydride, styrene copolymerized with acrylic acid and polyacrylic acid, with (ii) a polyalkenyl derivative of (iii) an ethylenically unsaturated carboxylic reagent selected from the group consisting of monoethylenically unsaturated $C_4$–$C_{10}$ dicarboxylic acids and anhydrides, and (iv) a polyamine containing at least two groups selected from the group consisting of —$NH_2$, —NH and mixtures thereof, wherein at least one of the ethylenically unsaturated compounds of the oligomer has a functional group which can react with an amine.

2. The oligomeric reaction product according to claim 1 which is further reacted with an amine having a molecular weight from 17 to 300.

3. The reaction product according to claim 2 wherein the amine is selected from the group consisting of aniline and polyamines containing at least two —$NH_2$ or —NH groups.

4. The reaction product according to claim 3, wherein the ethylenically unsaturated carboxylic reagent is selected from monoethylenically unsaturated $C_{4-10}$ dicarboxylic acids.

5. The reaction product according to claim 1 wherein the polyalkenyl derivative is derived from a polyalkene which is a polymer of at least one $C_{2-5}$ monoolefin.

6. The reaction product according to claim 1, wherein the polyamine is a compound of the general formula $$H_2N—(CHR^1)_x—CH_2—[A—CH_2—(CHR^1)_x]_y—NH_2 \quad (I)$$

wherein A is —NH or —O—, each $R^1$ independently represents a hydrogen atom or a methyl group, x is in the range 1 to 3, and y is in the range 1 to 10 when A is —NH or y is in the range 1 to 200 when A is —O—.

7. A lubricating oil composition comprising a major amount of a lubricating oil and a minor amount of a reaction product according to claim 1.

8. A lubricating oil composition comprising a major amount of a lubricating oil and a minor amount of a reaction product according to claim 3.

9. An additive concentrate comprising an inert carrier fluid and from 10 to 80% w, based on the total concentrate, of a reaction product according to claim 1.

10. A process for the preparation of a reaction product according to claim 1 which comprises reacting: oligomer (i) with reagents (ii) and (iv).

11. The reaction product according to claim 3, wherein the ethylenically unsaturated carboxylic reagent is selected from anhydrides.

12. The reaction product according to claim 11, wherein the anhydride is maleic anhydride.

13. A reaction product of (i) an oligomer formed from one monomer or two or more different monomers, the or each monomer being an ethylenically unsaturated compound, said oligomer or each of said monomers being optionally partially or fully esterified, wherein the oligomer formed is selected from the group consisting of styrene copoloymerized with maleic anhydride, styrene copoloymerized with acrylic acid and polyacrylic acid, with (v) a preformed product of (ii) a polyalkenyl derivative of (iii) an ethylenically unsaturated carboxylic reagent selected from the group consisting of monoethylenically unsaturated $C_4$–$C_{10}$ dicarboxylic acids and anhydrides, and (iv) a polyamine containing at least two groups selected from the group consisting of —$NH_2$, —NH and mixtures thereof, wherein at least one of the ethylenically unsaturated compounds of the oligomer has a functional group which can react with an amine.

14. The reaction product according to claim 13 wherein the amine is selected from the group consisting of aniline and polyamines containing at least two —NH or —NH groups.

15. A process for the preparation of a reaction product according to claim 13 which comprises reacting: oligomer (i) with (v) the preformed product of reagents (ii) and (iv).

16. The oligomeric reaction product according to claim 13 which is further reacted with an amine having a molecular weight from 17 to 300.

* * * * *

UNITED STATES PATENT AND TRADEMARK OFFICE

CERTIFICATE OF CORRECTION

PATENT NO. : 6,127,322
DATED : October 3, 2000
INVENTOR(S) : R.M. Scott, R. W. Shaw It is certified that error appears in the above-identified patent and that said Letters Patent is hereby corrected as shown below:

Claim 14,
Line 3, first instance, delete "-NH" and insert -- $-NH_2$ --.

Signed and Sealed this

Eighteenth Day of September, 2001

*Attest:*

Nicholas P. Godici

NICHOLAS P. GODICI
*Acting Director of the United States Patent and Trademark Office*

*Attesting Officer*